US005893216A

United States Patent [19]

Smith et al.

[11] Patent Number: 5,893,216

[45] Date of Patent: Apr. 13, 1999

[54] WALL-DRYING SYSTEM

[76] Inventors: Terry C. Smith, 16435 SE. 34th St., Bellevue, Wash. 98008; Ernest J. Storrer, Jr., 12831 NE. 136th St., Kirkland, Wash. 98034

[21] Appl. No.: 08/890,141

[22] Filed: Jul. 9, 1997

[51] Int. Cl.[6] ..... F26B 25/00

[52] U.S. Cl. ..... 34/103; 34/104; 34/181

[58] Field of Search ..... 34/383, 413, 417, 34/437, 439, 447, 487, 507, 103, 104, 181; 454/271, 305; 239/71, 556, 565, 587.5

[56] References Cited

U.S. PATENT DOCUMENTS

| | | | |
|---|---|---|---|
| 4,391,619 | 7/1983 | Shono et al. | 239/498 X |
| 5,408,759 | 4/1995 | Bass | 34/104 |
| 5,555,643 | 9/1996 | Guasch | 34/104 X |

*Primary Examiner*—Henry Bennett
*Assistant Examiner*—Steve Gravini
*Attorney, Agent, or Firm*—David L. Tingey

[57] ABSTRACT

A pressurized air distribution network of conduits terminates in small, needle-like nozzles adapted to penetrate a wall, ceiling or layers of flooring, or other moisture-laden areas, such as trapped air space beneath cabinets, through an unobtrusive, easily repaired hole. Air is dispersed by positive-pressure nozzles within the area and collected by nozzles of negative pressure relative to the air pressure within the area. To maintain equal air distribution about a large area, air pressure at the several positive-pressure nozzles is maintained approximately the same by an air supply ring disposed about the relevant room. Spaced apart about the ring are several manifolds, each feeding air to a nozzle. The ring is maintained at near constant pressure, that is, with minimum pressure gradation about the ring, by attaching several air blowers around the ring. In lieu thereof, a central blower provides air to a duct which divides at least once into multiple conduits at at least one branch location. Conduits vary in cross-section so that the conduits may be distributed along the moisture-laden area with larger conduits farther from a branch point and smaller conduits closer to maintain near-equal pressure at respective nozzles at conduit ends. Nozzles disperse air within the drying area by providing a discharge orifice at its distal end and at least one circumferential orifice at the distal end to create a Bernoulli effect. The nozzles are retained in place in the wall by longitudinal ribs along the nozzle circumference ending tapered at the insertion, distal end and ending abruptly in a radial surface that abuts the wall inner surface when the nozzle is rotated after insertion, thus preventing self-extraction when air is discharged out of the nozzle end.

21 Claims, 5 Drawing Sheets

WALL-DRYING SYSTEM

This invention relates to dryer systems for water-damaged floors, ceilings and walls. Specifically, it relates to a removable dryer system for temporary application of concentrated drying by air focussed specifically on a wet area of a wall, floor or ceiling by attachment uniquely at the area of damage or directed uniquely to the area of damage.

It is known in the art to have systems for drying floors and walls dry. For example, U.S. Pat. No. 5,155,294 by Smith, co-inventor herein, describes a high-volume, forced air blower attached to a selective air diverter configured to attach to various flat surfaces or corners in a room forcing dry air between partitioning studs in walls, through flutes typically found in tongue-in-groove flooring, and similarly behind ceilings. However, prior systems failed to provide a small-diameter nozzle for unobtrusively penetrating a wall, leaving only a small hole easy to repair while still providing necessary air flow volume. It was also unknown to have a network of air supply tubes for distributing air from an air supply means to several nozzles strategically placed about a room through walls, ceiling, or floor.

It is an objective of the present invention to provide a means to distribute air to several nozzles located throughout a moisture-laden area of a room, which nozzles are inserted through unobtrusive holes in a wall, ceiling, or floor that are easily repaired. It is also an objective that air be delivered to the several nozzles such that air pressure at the nozzles be approximately the same. It is a further objective that pressure relief be provided such that all air introduced into a moisture-laden area is also removed to avoid dispersion of bacterial growth or other contaminants that might be found in the area. It is a yet further objective that the air introduced into the area be dispersed generally to reach and dry all portions of the area. It is a final objective that means be provided to cover a wet surface material to establish an enclosed area suitable for drying with the above system.

SUMMARY

These objectives are achieved in a pressurized air distribution network of conduits terminating in small, needle-like nozzles adapted to penetrate a wall, ceiling or layers of flooring, or other moisture-laden areas, such as trapped air space beneath cabinets, through an unobtrusive, easily repaired hole. Air is dispersed by positive-pressure nozzles within the area and collected by nozzles of negative pressure relative to the air pressure within the area.

To maintain equal air distribution about a large area, air pressure at the several positive-pressure nozzles is maintained approximately the same by means of an air supply ring disposed about the relevant room. Spaced apart about the ring are several manifolds, each feeding air to a nozzle. The ring is maintained at near constant pressure, that is, with minimum pressure gradation about the ring, by attaching several air blowers around the ring. In lieu thereof, a central blower provides air to a duct with divides at least once into multiple conduits at at least one branch location. Conduits vary in cross-section so that the conduits may be distributed along the moisture-laden area with larger conduits farther from a branch point and smaller conduits closer to maintain near-equal pressure at respective nozzles at conduit ends.

Nozzles disperse air within the drying area by providing an discharge orifice at its distal end and at least one circumferential orifice around the distal end to create a bernoulli effect with reduced pressure about the nozzle circumference drawing air into such reduced-pressure regions before the air is exhausted out of the area. The circumferential orifices also serve as alternate discharge holes if the end orifice is plugged, thus maintaining a viable air supply system.

The nozzles are retained in place in the wall or equivalent by longitudinal ribs along the nozzle circumference ending tapered at the insertion, distal end and ending abruptly in a radial surface that abuts the wall inner surface when the nozzle is rotated after insertion, thus preventing self-extraction when air is discharged out of the nozzle end.

DETAILED DESCRIPTION OF THE PREFERRED EMBODIMENTS

The dryer system of the present invention designed to dry moisture-laden materials and trapped-air cavities, or wet areas, comprises a needle nozzle 10, a network of conduits 30, distributed air blowers 50, and a cover sheet 60.

Figure 1:
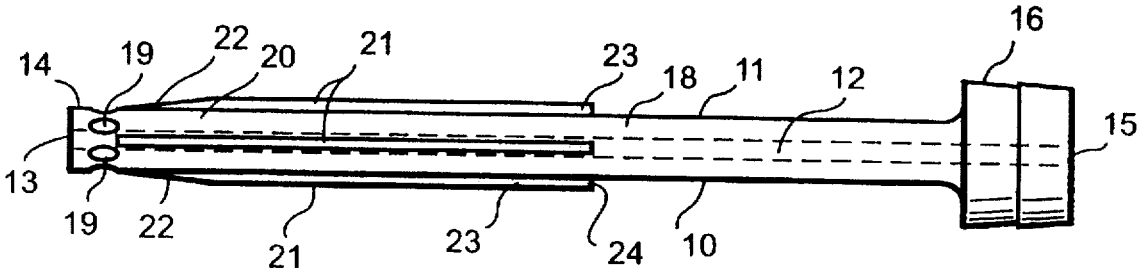
FIG. 1 is a side view of the nozzle of the present invention.
Figure 2:
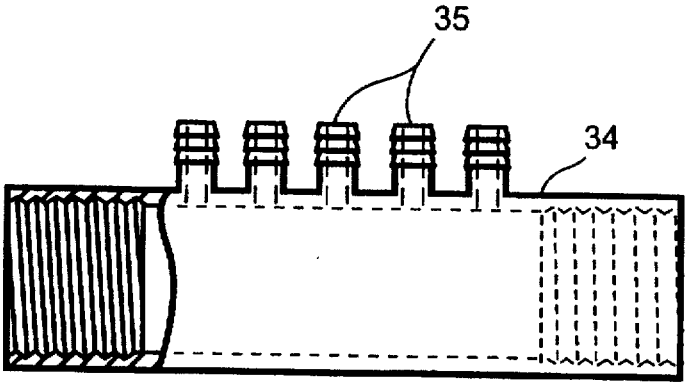
FIG. 2 is a perspective view of a manifold to which conduits feeding the nozzles are connected.
Figure 10:
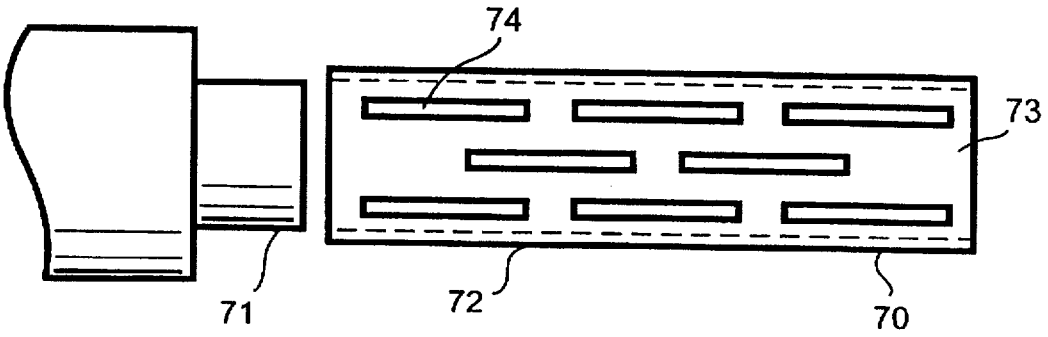
FIG. 10 is a side view of a blower noise reduction device.
Figure 3:
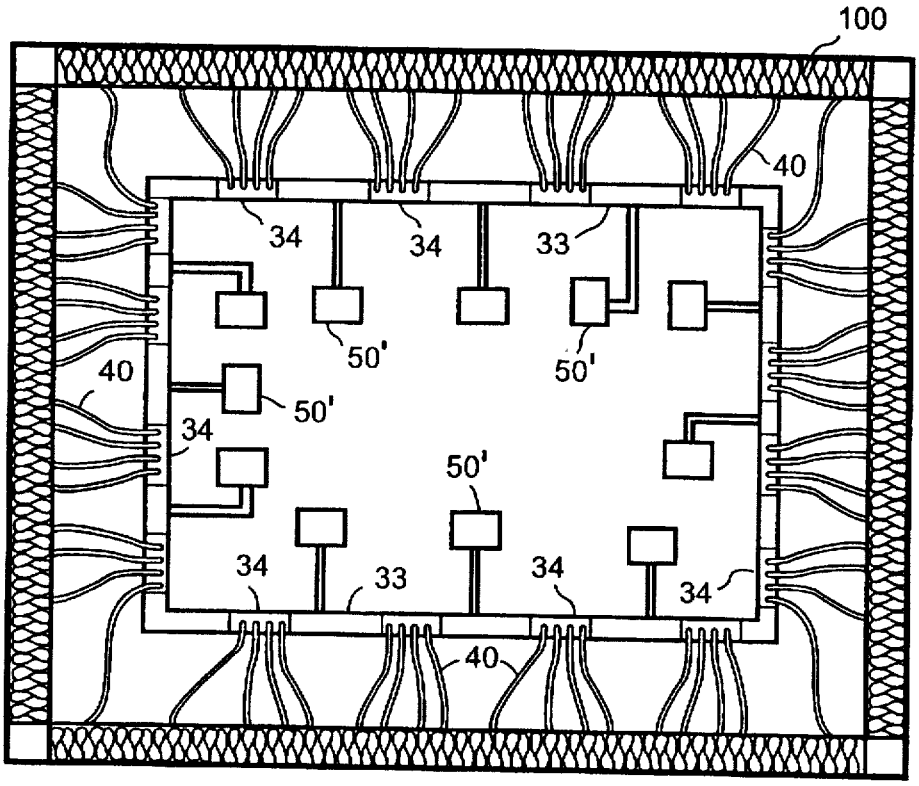
FIG. 3 is a distribution ring containing the manifolds spaced apart along the ring.
Figure 4:
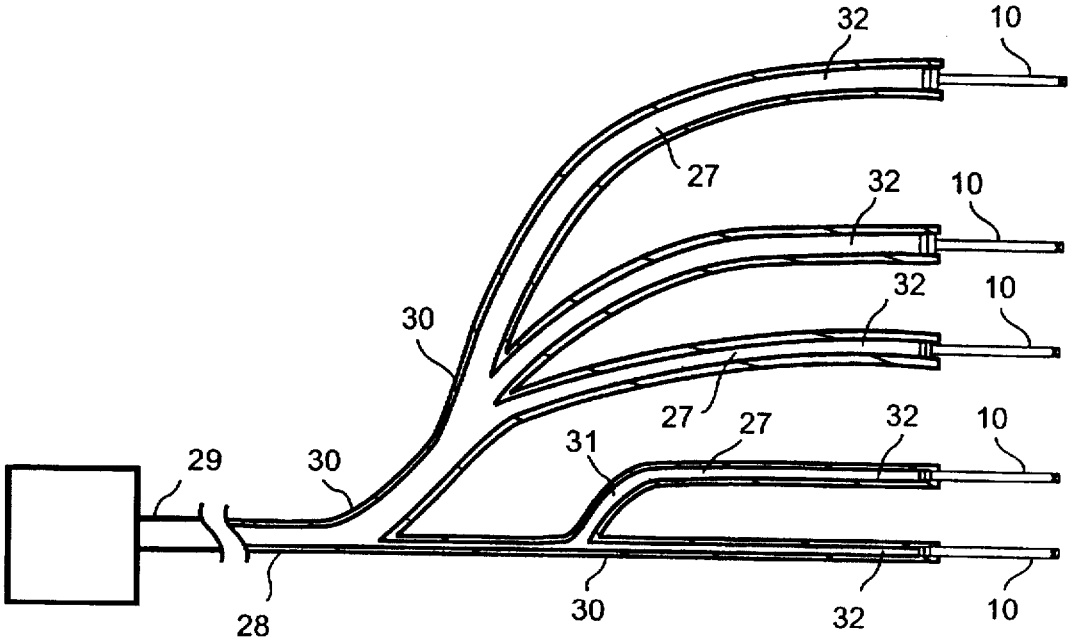
FIG. 4 shows an alternative air distribution system as a network of branching conduits branching of varying size.
Figure 5:
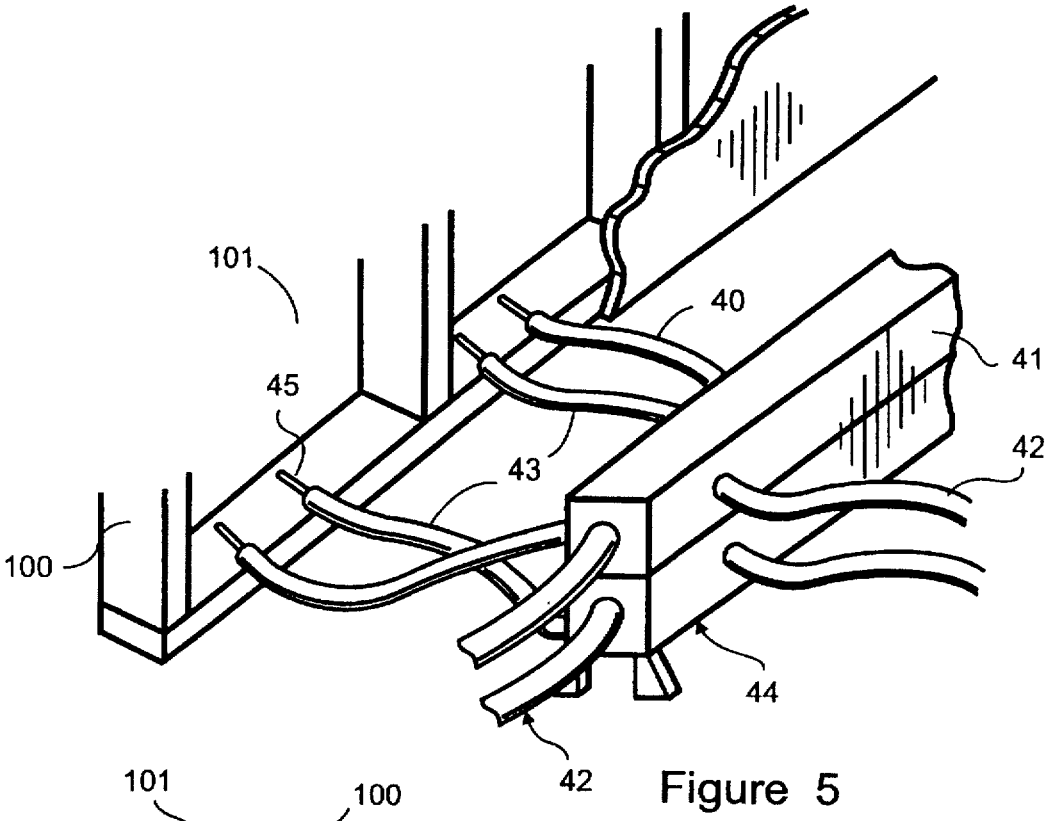
FIG. 5 is a cut-away view of positive-pressure nozzles in a wall dispersing air collected by negative-pressure nozzles.
Figure 6:
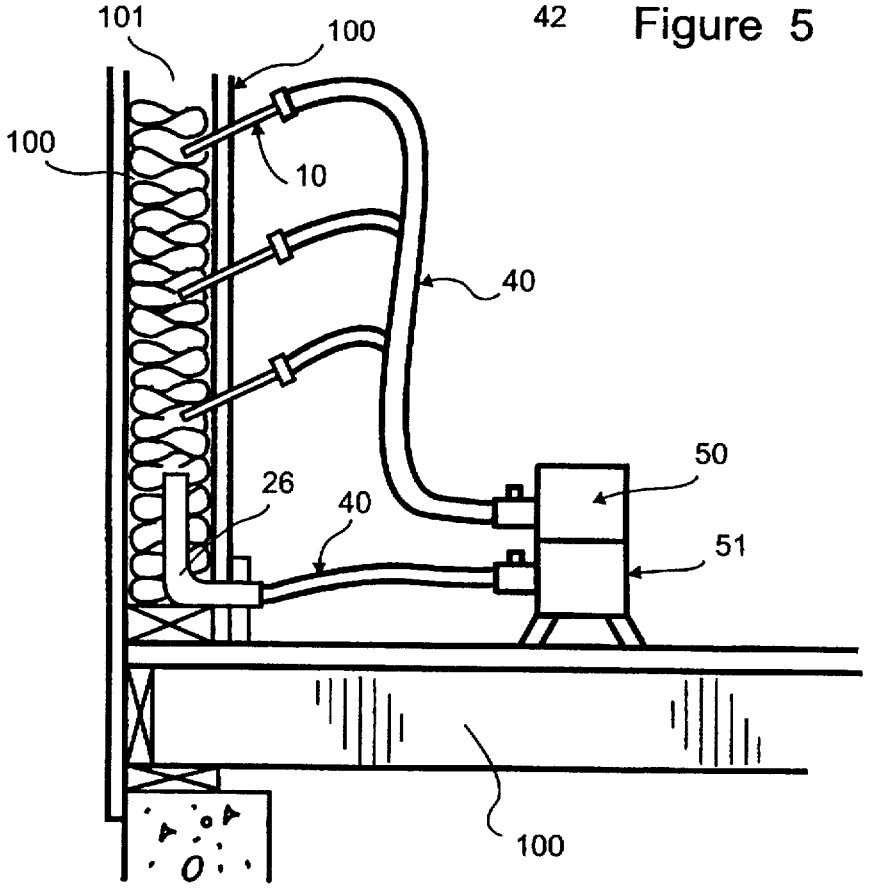
FIG. 6 is a cut-away view of a plurality of positive-pressure nozzles connected to a blower and an air-collecting negative-pressure nozzle connected to a vacuum device.
Figure 7:
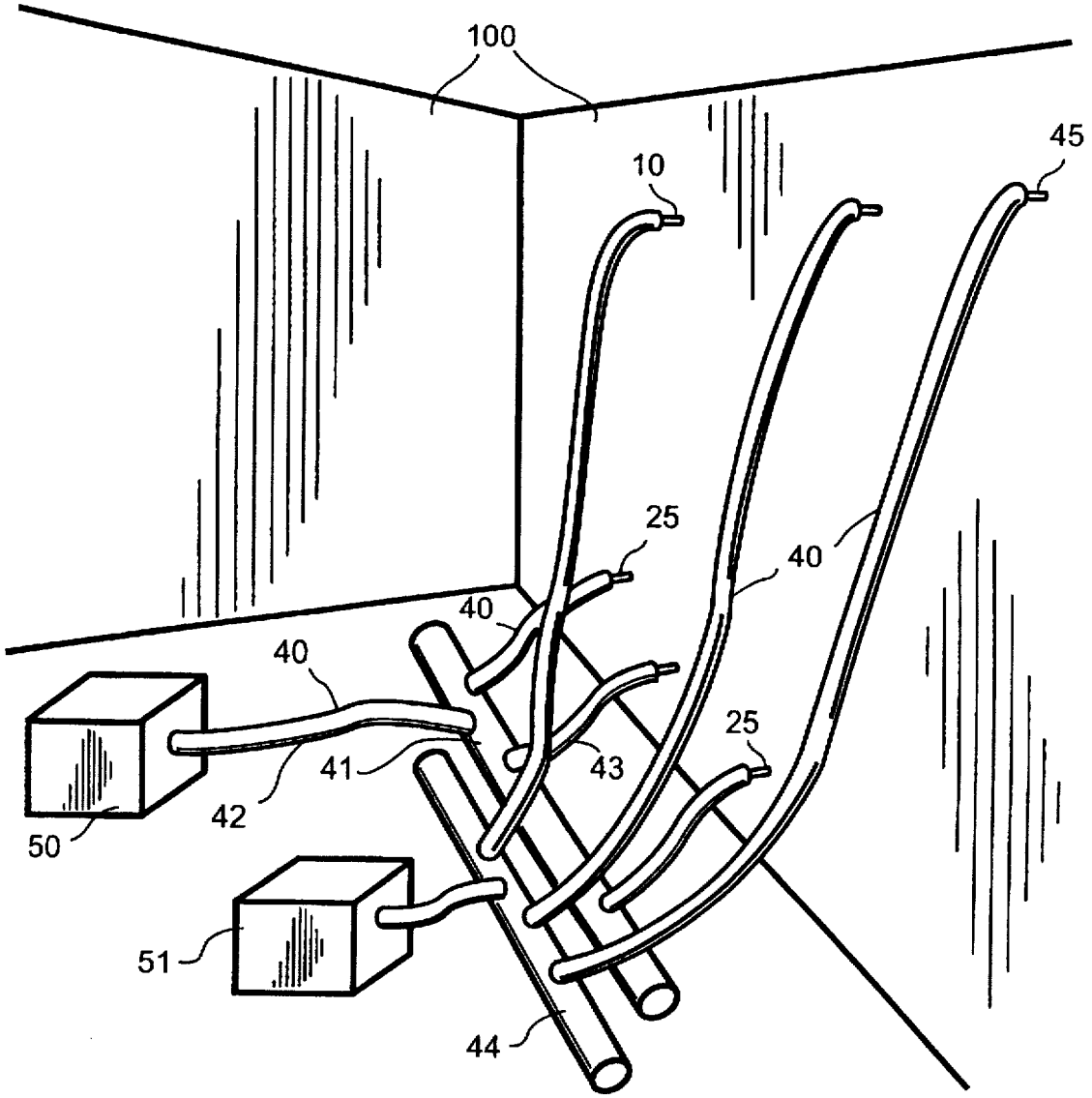
FIG. 7 is a perspective view of a vacuum and a blower each connected to a respective plenum from each of which are conduits between the plenums and nozzles located in a wet area wall.
Figure 8:
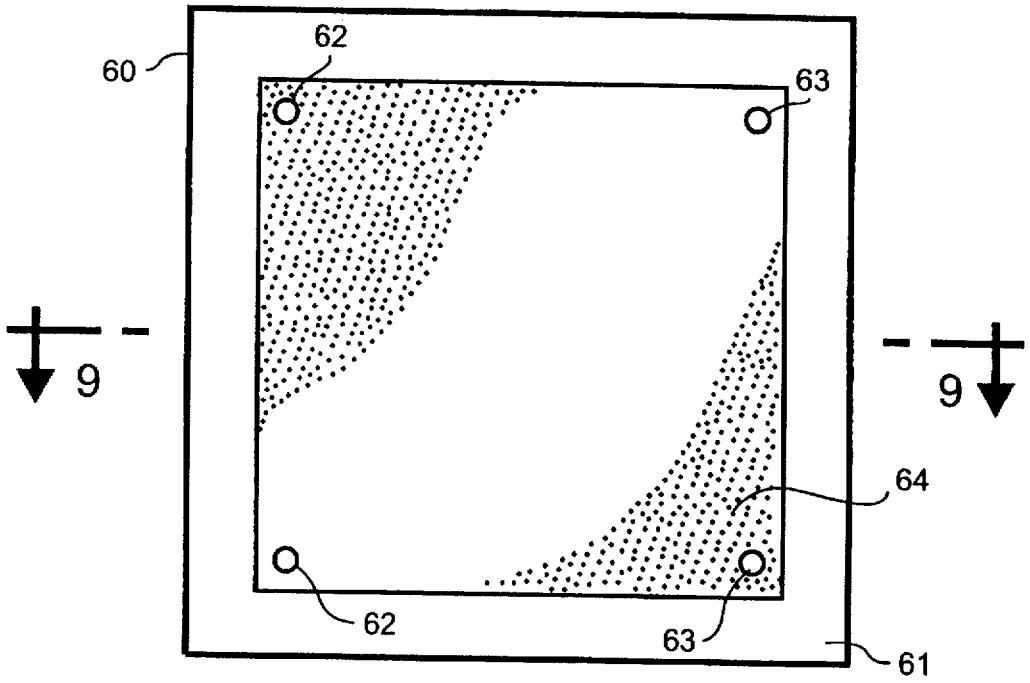
FIG. 8 is a underside planar view of a sheet for sealing over a moisture-laden area including a texturized undersurface for dispersing air over the area before air from positive-pressure nozzles escapes through discharge holes.
Figure 9:
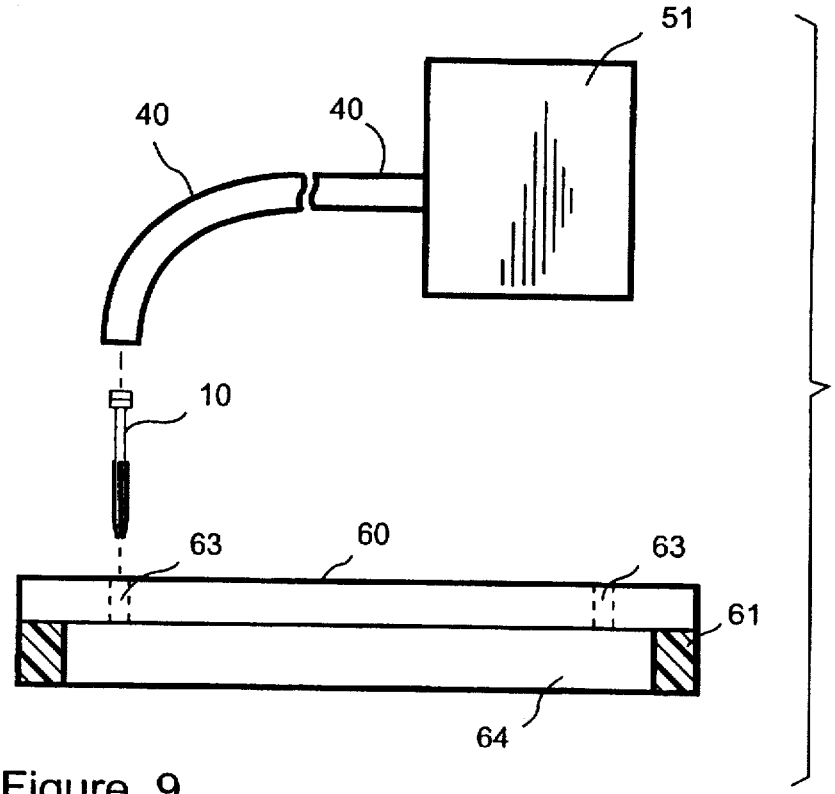
FIG. 9 is a view of the sheet of FIG. 8 along line 9—9.

Referring to FIG. 1, the needle nozzle 10 comprises a small-diameter, elongate, hollow cylinder 11 forming a single passageway 12 therethrough with a discharge first orifice 13 on a distal end 14 and an input second orifice 15 on a proximal end 16. In this regard, the proximal end 16 refers to that end to which may be attached an air pressure conduit 40. The distal end 14 refers to the opposite nozzle end intended to first penetrate a wall 100 and through which air is discharged from the nozzle.

The small diameter needle nozzle 10 with the single passageway 12 bounded by cylinder wall 18 for unidirectional passage of air flow is thus able to penetrate a wall, ceiling, flooring, or the like in a small, unobtrusive hole easy to repair quickly. By restricting the internal structure to a single passageway, air flow is maximized in the limited cross-section cylinder. Typically, the nozzle diameter is less than 3/16 inches and the passageway is less than 1/8 inches. The nozzle includes, in addition to the first and second orifices on the nozzle ends, a plurality of orifices 19 on the nozzle circumference near the nozzle distal end 14 communicating from the nozzle outer circumference 20 to its passageway within. With air flow passing through the nozzle and past the circumferential orifices 19, a bernoulli effect is achieved that causes a reduced air pressure about the nozzle in the region around the circumferential orifices. The reduced pressure has the effect of causing air injected through the discharge orifice to circulate and disperse generally within a trapped air space.

As air is discharged through the discharge orifice 13, a reactive force tends to cause the nozzle to self-extract from the hole in the wall through which the nozzle penetrated into the wet area. To retain the nozzle within the wall hole, the needle nozzle includes a plurality of parallel ribs 21 longitudinally on the nozzle and spaced apart circumferencially. Rib distal ends 22 are tapered to facilitate penetration through the wall and rib proximal ends 23 terminate in respective blunt ends 24 intermediate the nozzle, leaving nozzle length between the rib blunt ends 24 and the nozzle proximal end 16 that may remain in the wall hole while the ribs 21 fully pass out of the hole wall. The nozzle may then be rotated within the wall hole so that when it is impelled back as the air is discharged forward from the discharge hole, the rib blunt ends stop the nozzle against the wall.

The dryer system at least includes one nozzle connected on its proximal end to a positive-pressure air supply means, such as an air blower 50. Typically, a plurality of nozzles are employed in a water-damaged room, strategically located, through a network of tube conduits 40. Wet areas are prone to bacteria growth so as air is discharged through the network of positive-pressure conduits 40 with nozzles 10 into a relatively closed area 101, such as below cabinets or between studs behind walls or above ceilings or below layered flooring. Unless that air is also captured, said bacteria growth is carried by the air generally about the structure and areas around the area being dried. Therefore, a plurality of negative-pressure nozzles 25, or draw tubes 26, are also strategically placed about the wet area to capture inserted air and create a controlled air circulation within a localized wet area. It is only necessary that the draw tubes be of less pressure than the pressurized wet area so a vacuum mechanism 51 may be employed or the draw tube 26 may be simply routed to ambient pressure, preferably out of the building. Antibacterial decontaminating agents such as ozone may also be introduced into the air flow at at least one nozzle proximal end to kill the bacterial.

The network of positive-pressure air supply conduits 40 typically comprises a positive-pressure plenum chamber 41 fed by a conduit 42 from the air blower 50. A plurality of flexible conduits 43 with a nozzle on each end is then routed to strategic locations about the wet area. Similarly, a negative-pressure plenum 44 may be included with draw tubes between negative-pressure nozzles 45 or holes and the plenum with a vacuum mechanism maintaining a reduced pressure in the plenum.

Air is typically supplied to said nozzles by a continuous air supply ring conduit 33. A plurality of manifolds 34 are spaced apart about the ring, each manifold having at least one distribution port 35 disposed to distribute air within the ring to at least one nozzle 10 through a conduit connected therebetween. A plurality of air blowers 50' are connected to the ring, spaced apart such that air pressure at each manifold is approximately the same. In an alternative, the plurality of air blowers may be substituted by a central positive-pressure blower 50 from which run a plurality of air supply conduits to the ring in spaced-apart connections.

In an alternative embodiment, the network of flexible conduits 40 providing forced-air communication between the air blower 50 and the nozzles 10 may comprise a network of branching tubes 27. A first tube 28 is connected to the air blower at a first end 29. At at least one branch 30 intermediate the tube length, the tube 28 then divides into a plurality of tubes 31. After a small number of branches 30, the air feed tube 28 becomes a plurality of tubes 31, typically of varying length to facilitate placement at various distances from the blower, each tube terminating with a nozzle on its distal end providing configuration flexibility in relative placement of the nozzles in a wall. To maintain approximately the same air pressure at each nozzle even at varying tube length, the conduits have fluid passageways therethrough of different cross-sections 32 and therefore different pressure loss along their lengths. Thus, a larger cross-section tube is suitable for placement at a more distant location from the blower while relatively smaller cross-section tubes are placed in a wet area closer to the blower such that pressure to the plurality of nozzles is approximately the same.

Where the wet area also includes the wall 100 generally indicated as covering a moisture-laden area within, the wall also must be dried. To apply the features of the present invention that achieve controlled air flow, decontamination, and air recovery without significant impact to a room structure and finish, it is necessary to enclose the wall also. A planar sheet 60 is employed over a given wet wall 100 (which, again, for purposes throughout this disclosure "wall" is meant generically to include walls, ceilings, trapped air spaces, floor coverings, and the like). The sheet is sealed to the wall with a foam 61 about the perimeter of the sheet and between the sheet and the wall with the sheet spaced apart from the wall. The sheet has at least one insertion hole 62 through which air enters through the sheet. At least one relief hole 63 in the sheet allows the positive pressure air within to escape. A prime air mover provides a pressure difference between the at least one insertion holes and the at least one relief holes. Preferably, the prime air mover is a vacuum device, which tends to pull the sheet to the wall thereby improving or sustaining the air seal. Nozzles 10 may be employed in the sheet holes 62, 63 to facilitate attachment of conduits 40 at the holes and for the dispersion of and collection of air during drying.

To assure air dispersion under the sheet, a textured surface 64, such as carpet, is attached to the ring underside. The textured surface extends from the sheet underside sufficiently such that it contacts a wall with the sealing foam when the sheet is attached to a wall. Thus, the air must traverse the textured surface and air flow is interrupted and dispersed throughout the sheet from the insertion hole 62 to relief holes 63.

Because the air blower of the present system is typically needed in a closed room, it is advantageous to reduce blower noise as much as possible. To that end, a noise reduction filter 70 is employed at a blower air intake 71 that comprises a cylinder 72 with a tubular passageway 73 within and a plurality of elongated slots 74 on the cylinder circumference 75 communicating with the passageway, the slots being disposed longitudinally on the nozzle in a staggered relation and spaced apart circumferencially.

We claim:

1. A needle nozzle with a first orifice on a distal end and an opposite proximal end for connecting to a prime air mover of a reconfigurable dryer system adapted to dry moisture-laden trapped air cavities and materials, collectively referred to as a wet area, comprising an elongate, hollow, cylindrical, small-diameter needle nozzle forming a single passageway therethrough with a first orifice on a distal end and a second orifice on a proximal end, the nozzle comprising a cylinder wall for unidirectional air flow which nozzle is adapted to penetrate a wall covering the wet area to reach the wet area through a small, unobtrusive penetration hole in the covering wall, the needle nozzle having a plurality of orifices on the nozzle circumference near the nozzle distal end and communicating with the passageway within and adapted to achieve a bernoulli effect from air flow passing past the circumferential orifices in the passageway.

2. A needle nozzle with a first orifice on a distal end and an opposite proximal end for connecting to a prime air mover of a reconfigurable dryer system adapted to dry moisture-laden trapped air cavities and materials, collectively referred to as a wet area, comprising an elongate, hollow, cylindrical, small-diameter needle nozzle forming a single passageway therethrough with a first orifice on a distal end and a second orifice on a proximal end, the nozzle comprising a cylinder wall for unidirectional air flow which nozzle is adapted to penetrate a wall covering the wet area to reach the wet area through a small, unobtrusive penetration hole in the covering wall a plurality of parallel ribs with respective distal ends toward the nozzle distal end and proximal ends toward the nozzle proximal end, the ribs disposed longitudinally on the nozzle and spaced apart around the nozzle circumference.

3. The needle nozzle of claim 2 in which the ribs terminate in respective blunt ends intermediate the nozzle, the ribs being of length to fully pass through the wall, the nozzle then rotatable with the ribs through the wall becoming a nozzle stop against the wall to prevent self extraction from exhaust of air flow in the passageway.

4. The needle nozzle of claim 2 in which the ribs terminate in a taper to the nozzle outer surface near the nozzle distal end to facilitate insertion through the wall.

5. A reconfigurable and transportable temporary dryer system adapted to dry a moisture-laden area covered by a wall, comprising a prime air mover means, a first plurality of air nozzles in fluid communication with the prime air mover means which nozzles are adapted to penetrate said wall for moving air through the area, means for moving air through the first plurality of nozzles such that air flows through each of said nozzles under approximately the same pressures, at least one additional nozzle adapted to be spaced apart in the wall from the first plurality of air nozzles wherein the means for moving air through the plurality of nozzles maintains pressure in said first plurality of nozzles different from the at least one additional nozzle to produce a controlled air flow between the first plurality of nozzles and the at least one additional nozzle.

6. The system of claim 5 wherein the prime air mover means includes a positive-pressure air blower.

7. The system of claim 5 wherein the prime air mover means includes a vacuum drawing device.

8. The system of claim 5 in which at least one of the nozzles comprises an elongate, hollow, cylindrical, small-diameter needle nozzle forming a single passageway therethrough with a first orifice on a distal end and a second orifice on a proximal end, the nozzle comprising a cylinder wall for unidirectional air flow which nozzle is adapted to penetrate a wall covering the wet area to reach the wet area through a small, unobtrusive penetration hole in the covering wall.

9. A reconfigurable and transportable temporary dryer system adapted to dry a moisture-laden area covered by a wall, comprising a prime air mover means, a first plurality of air nozzles in fluid communication with the prime air mover means which nozzles are adapted to penetrate said wall for moving air through the area, means for moving air through the first plurality of nozzles such that air flows through each of said nozzles under approximately the same pressure, including means for delivering positive-pressure air to the plurality of nozzles that comprises a network of flexible tubing providing forced-air communication between the air blower and the nozzles, the tubing connecting to the air blower at a first end and dividing in a branching network to a plurality of distal second ends terminating with a nozzle attached thereto therein providing configuration flexibility in relative placement of the nozzles in a wall.

10. The system of claim 9 wherein said conduit and said nozzles attached on conduit distal ends have fluid passageways therethrough of different cross-sections, respectively, suitable for alignment of nozzles with larger cross-section passageways more distant from the plenum such that pressure to the plurality of nozzles is approximately the same.

11. A reconfigurable and transportable temporary dryer system adapted to dry a moisture-laden area covered by a wall, comprising a prime air mover means, a first plurality of air nozzles in fluid communication with the prime air mover means which nozzles are adapted to penetrate said wall for moving air through the area, means for moving air through the first plurality of nozzles such that air flows through each of said nozzles under approximately the same pressure, a continuous air supply ring conduit for air distribution to said nozzles, a plurality of manifolds spaced apart about the ring each having at least one distribution port disposed to distribute air within the ring to at least one nozzle through a conduit connected therebetween such that pressure to the plurality of nozzles is approximately the same.

12. The system of claim 11 further comprising a plurality of positive-pressure air supply means spaced about the ring such that air pressure at each manifold is approximately the same.

13. The system of claim 12 in which the plurality of positive-pressure air supply means comprises a central positive-pressure air supply means, a plurality of air supply conduits with first ends connected to said air supply means and with second ends connected to input ports spaced about the ring such that air pressure at each manifold is approximately the same, said air supply conduits adapted to deliver approximately the same pressure to each input port.

14. A reconfigurable and transportable temporary dryer system adapted to dry a moisture-laden area covered by a wall, comprising a prime air mover means, a first plurality of air nozzles in fluid communication with the prime air mover means which nozzles are adapted to penetrate said wall for moving air through the area, means for moving air through the first plurality of nozzles such that air flows through each of said nozzles under approximately the same pressure, wherein the wall comprises a planar sheet having an insertion hole and a sealing means about the sheet perimeter adapted to seal the sheet around a moisture-laden area of the wall with the sheet spaced apart therefrom, and the nozzles comprise at least one relief hole in the sheet for removing air from between the sheet and the moisture-laden area of the wall, and at least one insertion hole in the sheet through which air passes to within the sheet and the moisture-laden area of the wall.

15. The system of claim 14 wherein the "wall" further comprises a textured surface on a sheet inside face disposed to mount opposite the moisture-laden area and adapted such that air moving from the insertion hole is dispersed throughout the sheet inside face by the textured surface.

16. A reconfigurable and transportable temporary dryer system adapted to dry a moisture-laden area covered by a wall, comprising a prime air mover means, a first plurality of air nozzles in fluid communication with the prime air mover means which nozzles are adapted to penetrate said wall for moving air through the area, means for moving air through the first plurality of nozzles such that air flows through each of said nozzles under approximately the same pressure, a noise reduction filter on the air blower comprising a cylinder with a tubular passageway within and having a plurality of elongated slots on the cylinder circumference communicating with the passageway.

17. The system of claim 16 in which the slots are disposed longitudinally on the nozzle and spaced apart circumferencially.

18. The system of claim 16 in which the slots are staggered longitudinally on the cylinder circumference.

19. The system of claim 9 further comprising a continuous air supple ring conduit for air distribution to said nozzles, a plurality of manifolds spaced apart about the ring each having at least one distribution port disposed to distribute air within the ring to at least one nozzle through a conduit connected therebetween such that pressure to the plurality of nozzles is approximately the same.

20. The system of claim 9 wherein the wall comprises a planar sheet having an insertion hole and a sealing means about the sheet perimeter adapted to seal the sheet around a moisture-laden area of the wall with the sheet spaced apart therefrom, and the nozzles comprise at least one relief hole in the sheet for removing air from between the sheet and the moisture-laden area of the wall, and at least one insertion hole in the sheet through which air passes to within the sheet and the moisture-laden area of the wall.

21. The system of claim 9 further comprising a noise reduction filter on the air blower comprising a cylinder with a tubular passageway within and having a plurality of elongated slots on the cylinder circumference communicating with the passageway.

* * * * *